US011278759B2

(12) United States Patent
Fewell

(10) Patent No.: US 11,278,759 B2
(45) Date of Patent: Mar. 22, 2022

(54) ENHANCED EXERCISE VEST

(71) Applicant: Ken Fewell, Arlington, TX (US)

(72) Inventor: Ken Fewell, Arlington, TX (US)

( * ) Notice: Subject to any disclaimer, the term of this patent is extended or adjusted under 35 U.S.C. 154(b) by 0 days.

(21) Appl. No.: 16/783,241

(22) Filed: Feb. 6, 2020

(65) Prior Publication Data

US 2020/0289875 A1 Sep. 17, 2020

Related U.S. Application Data

(60) Provisional application No. 62/817,608, filed on Mar. 13, 2019.

(51) Int. Cl.

| | |
|---|---|
| ***A63B 21/00*** | (2006.01) |
| ***A41D 1/04*** | (2006.01) |
| ***A41D 13/00*** | (2006.01) |
| ***A63B 21/16*** | (2006.01) |
| ***A63B 21/065*** | (2006.01) |
| *A63B 23/04* | (2006.01) |

(52) U.S. Cl.

CPC ..... *A63B 21/4007* (2015.10); *A41D 1/04* (2013.01); *A41D 13/0007* (2013.01); *A63B 21/065* (2013.01); *A63B 21/151* (2013.01); *A63B 21/16* (2013.01); *A63B 21/4005* (2015.10); *A41D 2300/32* (2013.01); *A41D 2300/33* (2013.01); *A63B 2023/0411* (2013.01)

(58) Field of Classification Search

CPC ..... A63B 21/02; A63B 21/04–0407; A63B 21/0442; A63B 21/055–0557; A63B 21/065–068; A63B 21/16–169; A63B 21/40–4001; A63B 21/4005; A63B 21/4007; A63B 21/4009; A63B 21/4025; A63B 2023/0411; A63B 2244/09; A41D 1/08–085; A41D 1/04; A41D 2600/10; A41D 2400/38; A41D 13/0512; A41D 13/0518; A41D 13/0525; A41D 13/0531; A47D 13/02; A45F 2003/045; A41C 1/08; A41F 15/00; A41F 15/002; A41F 15/02; A62B 35/00–04

USPC ..... 224/160, 637, 262; D3/214

See application file for complete search history.

(56) References Cited

U.S. PATENT DOCUMENTS 3,519,269 A * 7/1970 Howlett ..... A63B 21/018 482/120
3,565,424 A * 2/1971 Alcide ..... A63B 23/0355 482/131
3,972,238 A * 8/1976 Thatcher ..... A61B 5/224 482/128

(Continued)

*Primary Examiner* — Garrett K Atkinson
*Assistant Examiner* — Kathleen M Fisk
(74) *Attorney, Agent, or Firm* — Mark R. Kendrick

(57) ABSTRACT

An enhanced exercise vest for improving squatting exercise performance includes an upper portion; a bottom portion, the bottom portion including two front sections that wraps around a portion of the torso of the user and a back section; two shoulder straps; and two clasps or brackets. The two shoulder straps connect to a back surface of the main portion, the two shoulder straps to wrap around shoulders of a user, cross, and pass through a loop attached to the back section of the bottom portion. The two shoulder straps attach to each other across a front side of the bottom portion. Two clasps or brackets are attached to the two front sections of the bottom portion.

12 Claims, 4 Drawing Sheets

(56) References Cited

U.S. PATENT DOCUMENTS 4,731,882 A * 3/1988 Ekman ..... A62B 35/0031 2/69
4,948,122 A * 8/1990 Andrews, Sr. ..... A63B 21/065 482/105
5,588,940 A * 12/1996 Price ..... A63B 21/065 224/259
5,611,084 A * 3/1997 Garry ..... A41D 13/0525 2/102
5,613,926 A * 3/1997 Michaelson ..... A63B 21/0552 482/121
6,421,833 B2 * 7/2002 Khanamirian ..... A41D 13/0007 182/3
6,557,176 B2 * 5/2003 Franco-Sion ..... A63B 21/065 2/102
7,874,970 B2 * 1/2011 Glisan ..... A63B 21/0552 482/124
9,005,088 B2 * 4/2015 Sides, Jr. ..... A63B 21/4005 482/107
9,962,589 B2 * 5/2018 White ..... A01K 27/002
10,004,936 B1 * 6/2018 Ekstrom ..... A63B 21/4007
10,286,249 B1 * 5/2019 Sibhatu ..... A63B 21/065
10,898,751 B2 * 1/2021 Siu ..... A63B 21/1663
10,898,776 B1 * 1/2021 Arza ..... A63B 71/0622
2007/0021280 A1 * 1/2007 Tyree ..... A63B 21/4035 482/94
2007/0083975 A1 * 4/2007 Senegal ..... A63B 21/0552 2/102
2010/0300906 A1 * 12/2010 Moore ..... A45C 13/02 206/315.1
2011/0237399 A1 * 9/2011 Toback ..... A63B 21/0442 482/8
2013/0237388 A1 * 9/2013 Dallstream ..... A63B 21/4007 482/93
2014/0274593 A1 * 9/2014 Kelly ..... A63B 21/4043 482/105
2015/0342329 A1 * 12/2015 Formosa ..... A45F 3/08 224/666
2017/0181481 A1 * 6/2017 Doumit ..... A41D 13/0575
2017/0354530 A1 * 12/2017 Shagdar ..... A41D 13/0015
2018/0056107 A1 * 3/2018 Clarke ..... A63B 21/065
2020/0269082 A1 * 8/2020 Desrosiers ..... A63B 23/04

* cited by examiner

ENHANCED EXERCISE VEST

RELATED APPLICATION

This application claims priority to application Ser. No. 62/817,608, filed Mar. 13, 2019, entitled "Master Squat Vest," the disclosure of which is hereby incorporated by reference.

BACKGROUND

Squat exercises are able to target the back, midsection, lower body and buttocks to improve strength. Performing squat exercises may be difficult without a spotter. People may lack balance or stability and thus may get injured trying to perform squat exercises. Abandoning squat exercises can be detrimental to muscle development in the specific areas of the body. Accordingly, a suitable solution is desired.

DETAILED DESCRIPTION

Figure 1:
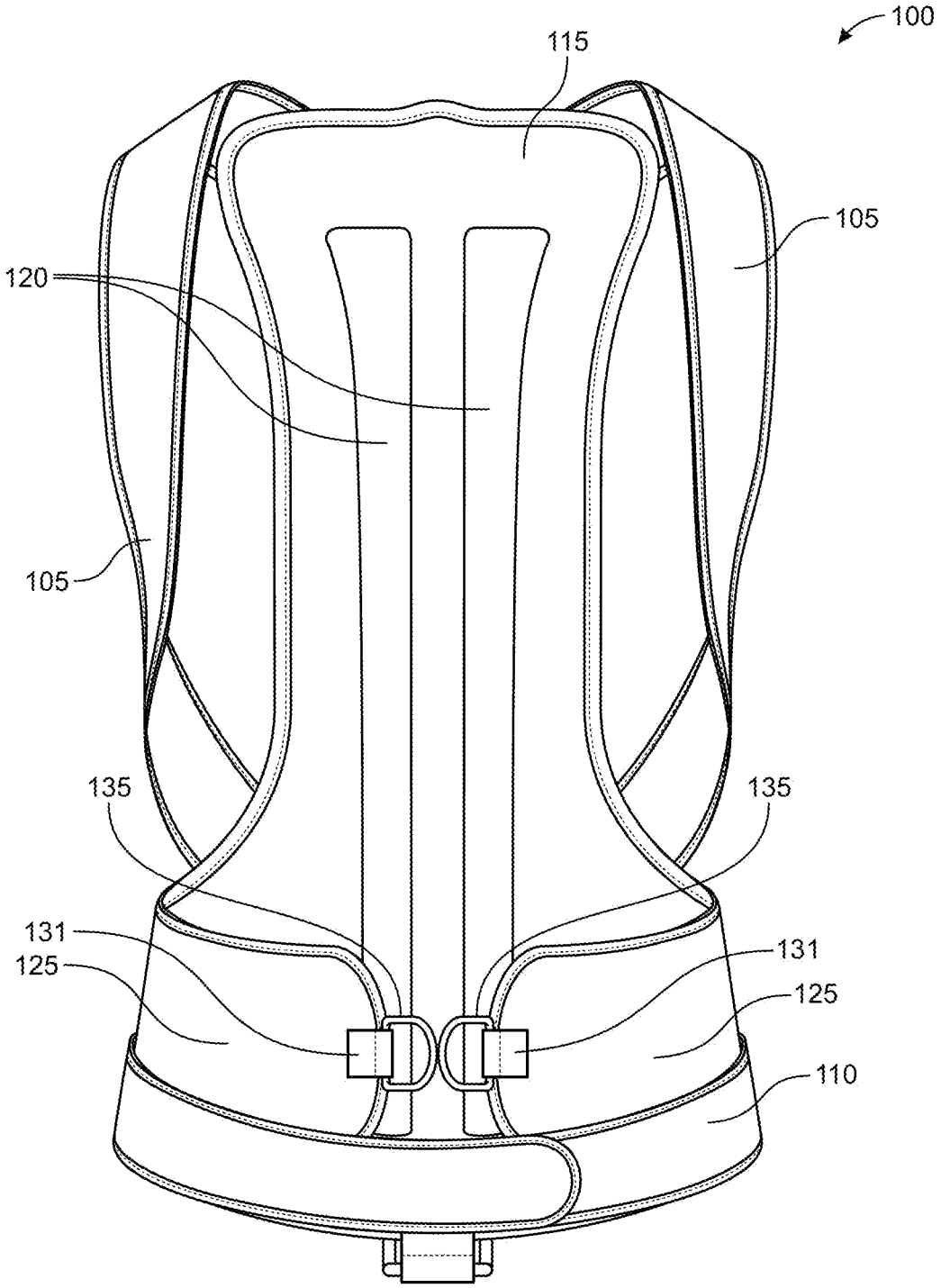
FIG. 1 illustrates a front view of the enhanced exercise vest according to some embodiments.

The foregoing, and other features and advantages of the invention and claimed subject matter, will be apparent from the following, more particular description of the preferred embodiments of the invention and claimed subject matter, the accompanying drawings, and the claims.

In the following detailed description, numerous specific details are set forth to provide a thorough understanding of claimed subject matter. For purposes of explanation, specific numbers, systems and/or configurations are set forth, for example. However, it should be apparent to one skilled in the relevant art having benefit of this disclosure that claimed subject matter may be practiced without specific details. In other instances, well-known features may be omitted and/or simplified so as not to obscure claimed subject matter. While certain features have been illustrated and/or described herein, many modifications, substitutions, changes and/or equivalents may occur to those skilled in the art. It is, therefore, to be understood that appended claims are intended to cover any and all modifications and/or changes as fall within claimed subject matter.

References throughout this specification to one implementation, an implementation, some embodiments, one embodiment, embodiments, an embodiment and/or the like means that a particular feature, structure, and/or characteristic described in connection with a particular implementation and/or embodiment is included in at least one implementation and/or embodiment of claimed subject matter. Thus, appearances of such phrases, for example, in various places throughout this specification are not necessarily intended to refer to the same implementation or to any one particular implementation described. Furthermore, it is to be understood that particular features, structures, and/or characteristics described are capable of being combined in various ways in one or more implementations and, therefore, are within intended claim scope, for example. In general, of course, these and other issues vary with context. Therefore, particular context of description and/or usage provides helpful guidance regarding inferences to be drawn.

Likewise, in this context, the terms "coupled", "connected," and/or similar terms are used generically. It should be understood that these terms are not intended as synonyms. Rather, "connected" is used generically to indicate that two or more components, for example, are in direct physical, including electrical, contact; while, "coupled" is used generically to mean that two or more components are potentially in direct physical, including electrical, contact; however, "coupled" is also used generically to also mean that two or more components are not necessarily in direct contact, but nonetheless are able to co-operate and/or interact. The term "coupled" is also understood generically to mean indirectly connected, for example, in an appropriate context.

The terms, "and", "or", "and/or" and/or similar terms, as used herein, include a variety of meanings that also are expected to depend at least in part upon the particular context in which such terms are used. Typically, "or" if used to associate a list, such as A, B or C, is intended to mean A, B, and C, here used in the inclusive sense, as well as A, B or C, here used in the exclusive sense. In addition, the term "one or more" and/or similar terms is used to describe any feature, structure, and/or characteristic in the singular and/or is also used to describe a plurality and/or some other combination of features, structures and/or characteristics.

Likewise, the term "based on," "based, at least in part on," and/or similar terms (e.g., based at least in part on) are understood as not necessarily intending to convey an exclusive set of factors, but to allow for existence of additional factors not necessarily expressly described. Of course, for all of the foregoing, particular context of description and/or usage provides helpful guidance regarding inferences to be drawn. It should be noted that the following description merely provides one or more illustrative examples and claimed subject matter is not limited to these one or more illustrative examples; however, again, particular context of description and/or usage provides helpful guidance regarding inferences to be drawn.

In some embodiments, the claimed subject matter provides users with an enhanced exercise vest designed to support the user's back while performing squat exercises. In some embodiments, the enhanced exercise vest may allow users to perform squatting exercises (or other exercises) with no supervision (or minimal supervision). In some embodiments, the enhanced exercise vest includes a pair of shoulder straps including a pair of lower straps for firmly securing the enhanced vest to the user for the squat exercises. In some embodiments, the enhanced vest allows users to equip a weight barbell or belt to a back side of the enhanced exercise vest to further customize and/or intensity the workout. In some embodiments, the enhanced vest may also include one or more attachment points, a bracket and/or a cable to allow a user to attach and/or clip the vest to a stable support structure, which reduces the chance of injury occurring to a loss of balance. In some embodiments, the stable support structure may have a door structure, a pole, a wall, a basketball support, a bench, a volleyball extension, or a rail. In some embodiments, the cable may attach to, couple to and/or wrap around a support structure such as a door frame, a weight bench, and/or a park bench. In some embodiments, the ability to easily clip onto a support structure allows the enhanced exercise vest user to apply, attach or connect the cable to the support structure and maintain stability which performing squatting exercises. In some embodiments, the user may now be able to perform squatting exercises without worry of an injury occurring. In some embodiments, this allows multiple exercises to be performed by utilizing the vest. In some embodiments, the enhanced vest may also allow a user to perform other exercises and enhance results. These exercises include side laterals, single platform leg lunges, hex squats, shoulder press while squatting, side laterals while squatting, triceps while squatting and/or lower back exercises. The enhanced vest may strengthen the buttocks muscle, the hamstrings and/or the calves of the users (along with other muscle groups).

In some embodiments, many sections of the attached vest may be constructed utilizing lightweight materials in order to minimize additional strain on a user's chest, abdomen, neck, shoulders and/or back. In some embodiments, many sections of the attached vest may be made of flexible materials and non-irritating materials so that if the enhanced weight vest touches the skin, there is no irritation or scratching. In addition, the use of flexible materials allows the enhanced vest to stretch over different user sizes. In some embodiments, the size of the enhanced weight vest may be varied in order to accommodate and/or fit different sizes of users.

Figure 2:
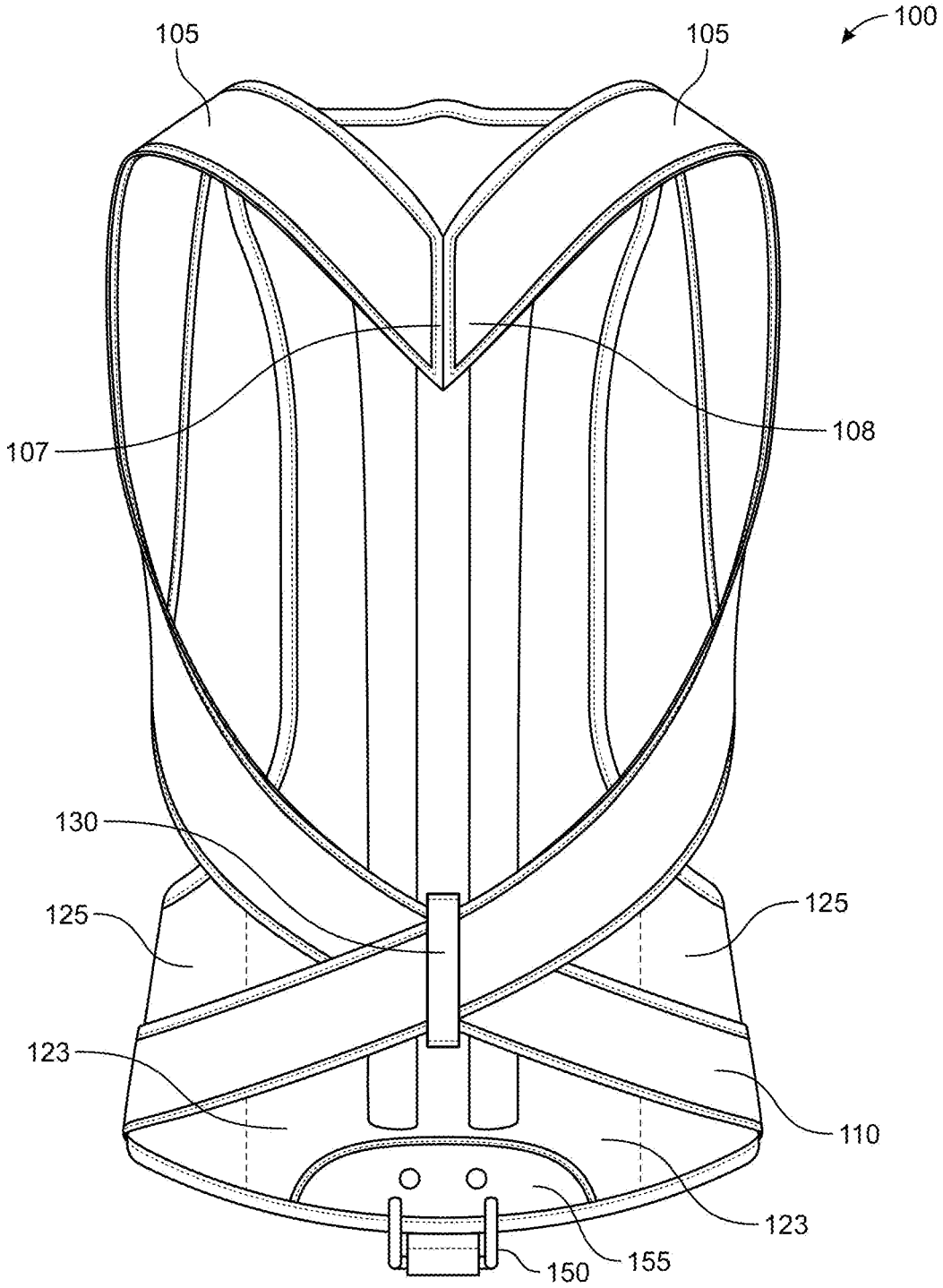
FIG. 2 illustrates a back view of the enhanced exercise vest according to some embodiments.

FIG. 1 illustrates a front view of the enhanced exercise vest according to some embodiments. FIG. 2 illustrates a back view of the enhanced exercise vest according to some embodiments. In some embodiments, the enhanced exercise vest 100 may include or comprise a top or upper portion or section 115, two or more upper portions of shoulder straps 105, two or more lower portions of the shoulder straps 110, a bottom section or portion 125, two or more clasps or brackets 135, and/or two or more clasp or bracket attachment assemblies 131. In some embodiments, a significantly novel aspect of the enhanced exercise vest 100 may be the utilization of the two or more clasps or brackets 135 and/or the two or more clasp or bracket attachment assemblies 131 to attach to a support structure via a cable assembly (not shown in FIG. 1, but shown and described below in FIGS. 3 and 4). This allows a user to obtain additional support when performing squatting exercises and other exercises as listed above. Normal exercise vests are not designed to be attached to fixed support structures and this is a significant advantage of the disclosed and claimed subject matter.

In some embodiments, the two or more upper portions of the shoulder straps 105 are attached to a back surface of the top or upper portion 115 of the enhanced exercise vest 100 at attachments points 107 and 108. In some embodiments, the shoulder straps 105 may be attached via an adhesive, via sewing or stiches or via rivets or other connectors. In some embodiments, the upper portion of the two or more shoulder straps 105 may extend vertically at approximately a 45-degree angle in order to be positioned. In some embodiments, the upper portion of the two or more shoulder straps 105 may extend vertically from the back surface of the top or upper portion 115 of the enhanced exercise vest in a range between 15 to 75 degrees. In some embodiments, the two or more upper portions of the shoulder straps 105 may extend around the user's shoulder and then run along a user's side until the two or more shoulder straps 105 cross at a user's back (as shown in FIG. 2). In some embodiments, a loop 130 may be attached to a lower back surface of the lower portion 125 of the enhanced exercise vest 100. In some embodiments, the two or more lower portion of the shoulder straps 110 may both pass through the loop 130 and/or may cross within the loop 130. In some embodiments, the loop 130 may be attached via an adhesive, a connector or stitching to the lower portion of the enhanced exercise vest. After the two or more shoulder straps 110 pass through the loop 130, the two or more shoulder straps may be referred to as the two or more lower portions of the shoulder straps 110. In some embodiments, the two or more lower portions of the shoulder straps 110 may then wrap around a torso and/or abdomen of the user and an end of one or the two or more lower portions of the shoulder straps 110 may have a hook and loop fastening system patch and another one of the two or more lower portions of the shoulder straps 110 may have a hook and loop fastening system receiving material so that two or more lower portions of the shoulder straps 110 are fastened together. Although a hook and loop fastening system is discussed here, other adhesive or attachable materials may be utilized to connect the ends of the two or more lower portions of the shoulder straps 110 together. In some embodiments, the two or more lower portions of the shoulder straps 110 may also be connected or attached together through other adhesives or connectors such as snaps, light adhesives, and/or similar fasteners. Please note that when the shoulder straps are passing through the loop 130, the reference number changes to 110. In some embodiments, this is the way that the enhanced exercise vest is attached to and/or placed on the user.

In some embodiments, two or more bottom portions 125 of the enhanced exercise vest 100 may also wrap around an abdomen of the user. However, the two or more bottom portions 125 of the front side of the enhanced exercise vest 100 may not be attached to each other (e.g., which is different than the bottom portions of the two or more shoulder straps 110 that do connect to each other). In other words, the two or more bottom portions 125 on the front side of the enhanced exercise vest may not touch each other, while a back part of the bottom portion 125 of the enhanced exercise vest is a singular piece providing support for the user's back. In some embodiments, the two or more bottom portions 125 on the front side and a back part of the bottom portion 125 the enhanced exercise vest may be made of a stronger, thicker material than the rest of the enhanced exercise vest 100. For example, in some embodiments, there may be a rigid material placed inside a cloth or polyester or nylon material to make the bottom portion 125 of the enhanced exercise vest to provide more support. Alternatively, the bottom portion 125 of the enhanced exercise vest (e.g., both the front portions and the back part) may be made of a thicker and stronger material. In some embodiments, the upper portion 115 of the enhanced exercise vest 100 may be made of a nylon or mesh material in order to accommodate different user sizes and allow flexibility when the user is performing the squatting exercises (or other exercises). In some embodiments, a bottom part of the upper portion 115 of the enhanced exercise vest may extend past the bottom portion of the enhanced exercise vest 100 and may attach to a back surface of the back part of the bottom portion 125 of the enhanced exercise vest 100. This construction provides additional strength and flexibility to the enhanced exercise vest because the upper portion 115 is attached to multiple points on a back part 123 of the bottom portion 125 of the enhanced exercise vest and thus will not be disconnected or detached from the bottom portion of the enhanced exercise vest. It should be noted that the bottom portion 125 of the enhanced exercise vest 100 includes a back part that is around the back of the user and two front portions that wrap around the hips of the user and that the bottom portion 125 is a singular piece. In some embodiments, the upper portion 115 of the enhanced exercise vest 100 may include two or more additional support elements 120 that provide the user with more support. In some embodiments, the two or more additional support elements 120 may run in a vertical direction up a back of the user. In some embodiments, the two or more additional support elements 120 may be made of a light metal or a stiff plastic or composite material. In some embodiments, the back side of the bottom portion 125 may also include additional support elements embedded therein in order to provide additional support to the user when performing exercises.

In some embodiments, the two or more bottom portions 125 on the front side of the enhanced exercise vest 100 each may include a clasp or bracket attachment assembly 131 and a clasp or bracket 135. In some embodiments, the fabric clasp or bracket attachment assemblies 131 may be sewn or riveted onto a side end section of the two or more bottom portions 125 of a front side of the enhanced exercise vest 100. In some embodiments, the two or more clasp or bracket attachment assemblies 131 may include two openings on one end (which extends past the side end section of the two or more bottom portions 125) that allows a clasp or bracket 135 (or one side of the clasp or bracket) to be inserted into the two or more openings. Thus, in some embodiments, the clasp or bracket attachment assemblies 131 may allow the enhanced exercise vest to hold the clasp or bracket 135 in place. In some embodiments, each of the bottom portions 125 of the front side of the enhanced exercise vest may have a clasp or bracket 135 held in place by the clasp or bracket attachment assemblies 131. In some embodiments, the clasp or bracket 135 may have a straight edge and a semicircular piece connecting on one end to a corresponding end of the straight edge and another end of the semicircular piece connected to the other corresponding end of the straight edge. In some embodiments, the two clasps or brackets 135 may be positioned right next to each other, as shown in FIG. 1. In some embodiments, the two clasps or brackets 135 may be positioned near enough to each other to allow a clip or ring or snap hook connector to connect onto both of the two clasps or brackets. In some embodiments, the two clasps or brackets 135 may be symmetrically positioned, meaning that the straight edges of the clasps or brackets may be inserted into the openings of the fabric clasp or bracket attachment assemblies 131 and the semicircular edges of the two or more clasps or brackets 135 may be facing each other and/or positioned in a same plane. In some embodiments, the two or more clasps or assemblies 135 may be made of a metal material, a light metal material, and/or a rigid plastic material. The two or more clasps or assemblies 135 may have to be sturdy and able to handle heavy loads in that during the squatting exercises, a user's weight may be a force asserted against the two or more clasps or assemblies 135.

In some embodiments, the enhanced exercise vest may include a weight attachment 150. In some embodiments, the weight attachment 150 may allow a dumbbell to be attached to the weight attachment 150. In some embodiments, the weight attachment 150 may include a couple of hooks that allow the dumbbell to be placed within. The inclusion of the weight attachment 150 with a dumbbell may allow additional force and/or weight to be placed onto the user and thus increase the intensity of the workout. In some embodiments, the weight attachment 150 may be connected and/or attached to a back surface 123 of the lower portion 125 of the enhanced exercise vest 100. In some embodiments, a weight attachment connector 155 may be riveted, adhered and/or attached to the back surface of a back part 123 of the lower portion 125 of the enhanced exercise vest 100. In some embodiments, the weight attachment connector 155 may be connected, coupled or attached to the weight attachment 150.

Figure 3:
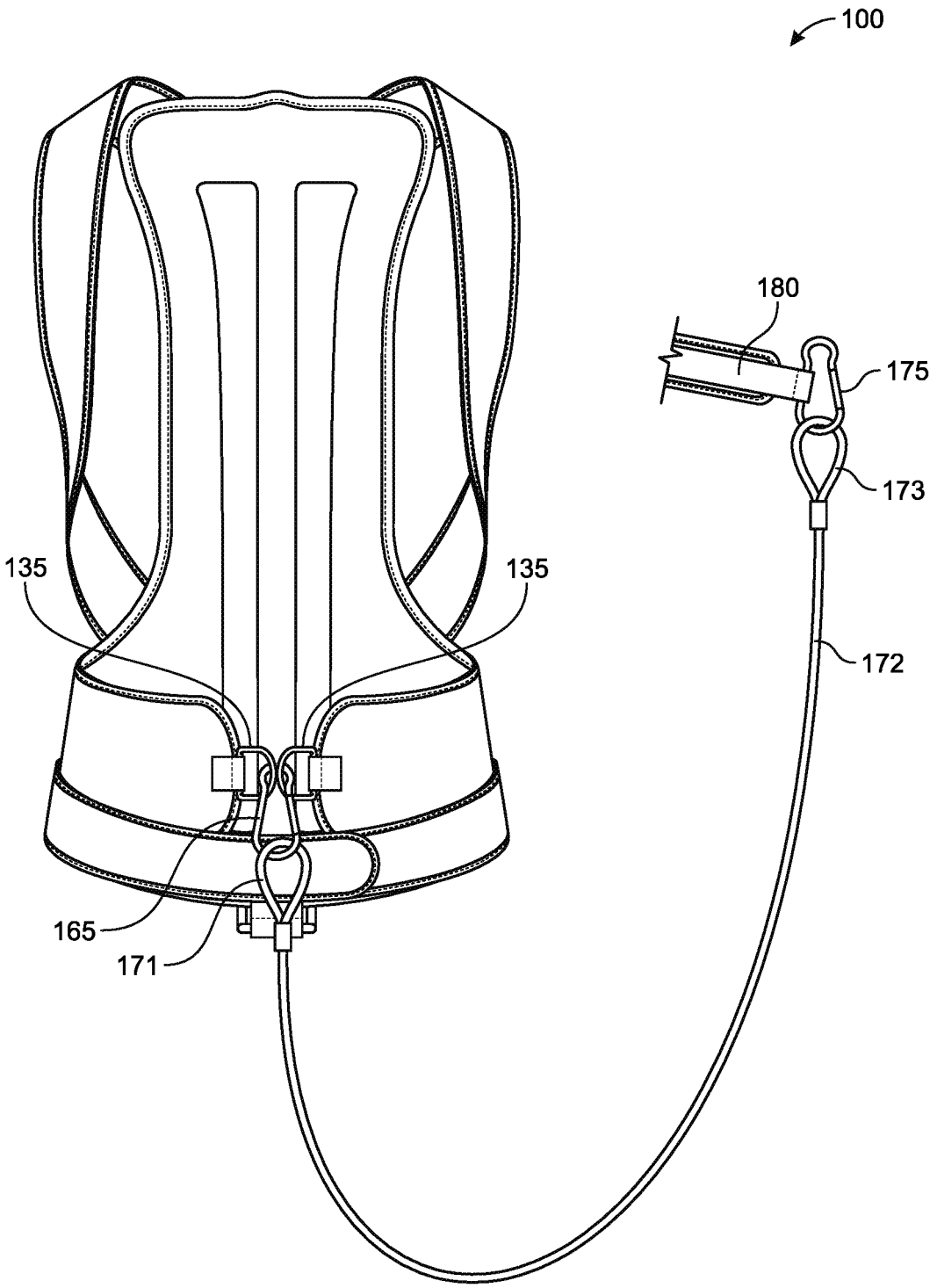
FIG. 3 illustrates an enhanced exercise vest including a cable assembly, and a first connector bracket or clasp, a second connector or clasp according to some embodiments.

FIG. 3 illustrates an enhanced exercise vest including a cable assembly, and a first connector bracket or clasp, a second connector or clasp according to some embodiments. In some embodiments, a cable assembly may include a first loop 171, a cable 172 and/or a second loop 173. In some embodiments, the cable assembly may be made of steel or another metal. In some embodiments, the cable assembly may be between 1.5 feet and 15 feet in length. In some embodiments, the cable assembly may be between six feet and eight feet in length. In some embodiments, the cable assembly may be between approximately seven feet in length. In some embodiments, the cable assembly may be a 7 foot, quarter-inch plastic coated cable. In some embodiments, the 7 foot, quarter-inch plastic coated cable may be best due to its strength and range from the apparatus or workout platform or pole or other stable structure. For example, it is important to have this length of cable and this type of cable due to its strength. In some embodiments, the first loop 171 and the second loop 173 allow the cable assembly to be attached to the enhanced exercise vest 100 via clips or rings or connectors 165 and 175. In some embodiments, the clips or rings or connectors may be a spring snap hook carabiner link. In some embodiments, the clips or rings or snap hook connectors 165 and 175 may be made of stainless steel. In some embodiments, the clips or rings or connectors may be a carbon-steel. In some embodiments, the clip or ring or connector 165 may connect the two or more clasps or brackets 135 to the first loop 171 of the cable assembly. In some embodiments, the clip or ring or connector 175 may connect the second loop 173 of the cable assembly to a support structure attachment 180. In some embodiments, the clip or ring or connector 165 and the clip or ring or connector 175 may have a side that allows attaching or placement of the clip or ring or connector 175 into the first loop 171 or the second loop 173. In some embodiments, a user may press against the side of the clip or ring or connectors 165 and 175 and a hinging assembly on the clip or ring or connectors 165 and 175 may allow the side to be depressed and move inwards (e.g., a snap hook connector).

Figure 4:
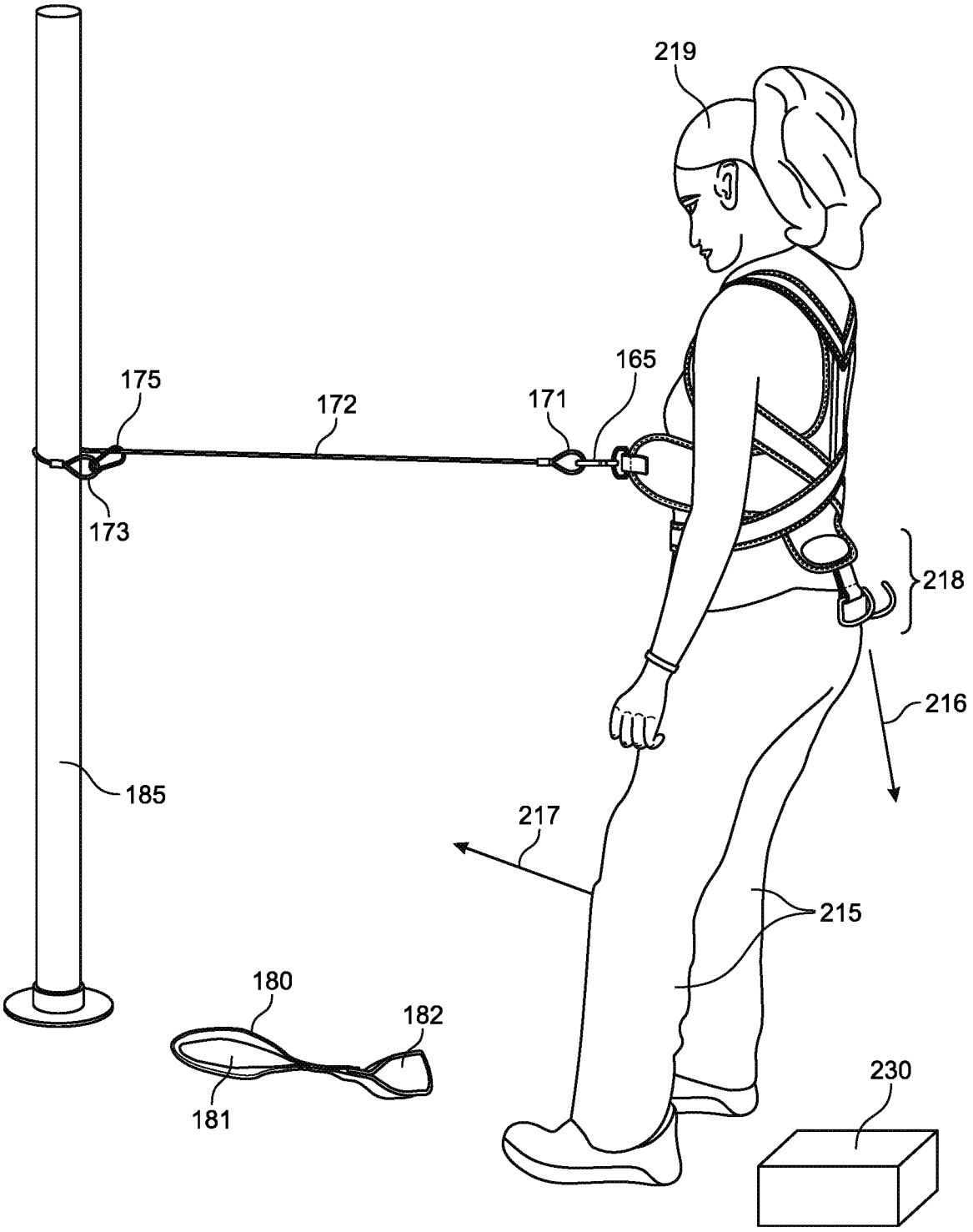
FIG. 4 illustrates an enhanced exercise vest including a cable assembly, a first connector bracket or clasp, a second connector or clasp in use and connected to a pole according to some embodiments.

In some embodiments, the support structure attachment may a door iamb assembly 180 (as shown in FIG. 4) which may be placed in a door iamb in order to prevent the door jamb assembly (and thus the cable assembly) from moving when a user is completing squatting exercises. In this embodiment, the second clip or ring or snap connector 175 may attach to one end of the door jamb assembly 180 (which has an opening 181 that allows the second clip or ring or snap connector 175 to be inserted inside and wrap around. In some embodiments, a second end of the door jamb assembly 182 may be made of a thicker material (which may be solid and may not have an opening) that has a width that cannot pass through a closed door (either on the side of the door or underneath the door). In this way, the second end 182 may be placed on the other side of the closed door, and the door becomes the support structure.

In some embodiments, the cable 172 may be wrapped around a support structure 185. In other words, the cable 172 of the cable assembly may be wrapped around the support structure 185 (in FIG. 4 the pole, but may also be a weight bench, a stationary weight machine, a post, a volleyball extension, a basketball extension, a park bench, heavy furniture with an open leg or arm made of a strong material, or some other stable structure). In some embodiments, one end of the cable 172 may be wrapped around the support structure 185 while the clip or ring or connector 175 is connected to the second loop 173. After the cable 172 of the cable assembly is wrapped around the support structure 185, the clip or ring or connector 175 may then connected or attached to the cable 172. In addition, a user may increase the effectiveness of the enhanced exercise vest, and the squatting exercises performed utilizing the enhanced exercise vest by standing on cork blocks 230, one of which is shown in FIG. 4.

FIG. 4 illustrates an enhanced exercise vest including a cable assembly, a first connector bracket or clasp, a second connector or clasp in use and connected to a pole according to some embodiments. In some embodiments, the user 219 may be engaging in squatting exercises. In some embodiments, the user may move their lower back or buttocks in a downward direction 216 (e.g., a downward vertical direction) while the user's may move their knees 215 in a second direction 217 (which may be perpendicular to the direction of movement 216). In some embodiments, the second loop 173 of the cable assembly may be connected or coupled to the clip or ring or connector 175 which may also be connected to cable 172. In some embodiments, the first loop 171 may be connected to the clip or ring or connector 165 which may be also connected or attached to the brackets or clasps 135 of the enhanced exercise vest 100.

The above disclosure is sufficient to enable one of ordinary skill in the art to practice the invention, and provides the best mode of practicing the invention presently contemplated by the inventor. While there is provided herein a full and complete disclosure of the preferred configurations of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims

The invention claimed is:

1. An enhanced exercise vest for improving squatting exercise performance, comprising:

an upper portion of the enhanced exercise vest;

a bottom portion of the enhanced exercise vest, the bottom portion including two front sections configured to wrap around a portion of a torso of a user and a back part;

two shoulder straps to connect to a back surface of the upper portion of the enhanced exercise vest, wherein the two shoulder straps are configured to wrap around respective shoulders of the user, cross each other, and pass through a loop attached to the back part of the bottom portion of the enhanced exercise vest, and wherein the two shoulder straps attach to each other across a front side of the bottom portion of the enhanced exercise vest;

two clasps or brackets each attached to corresponding fabric assemblies which are attached to a corresponding end of the two front sections of the bottom portion of the enhanced exercise vest;

a clip or ring or spring snap hook connector;

a cable assembly, wherein the cable assembly is configured to be connected to the two clasps or brackets of the enhanced exercise vest via the clip or ring or spring snap hook connector; and a weight attachment attached to the enhanced exercise vest via a weight attachment connector, wherein the weight attachment is configured to hold a dumbbell therein such that the dumbbell is suspended below the enhanced exercise vest when worn by the user.

2. The enhanced exercise vest of claim 1, wherein the cable assembly includes a first loop and a second loop, the first loop configured to be connected to the clip or ring or spring snap hook connector.

3. The enhanced exercise vest of claim 2, further comprising a support structure, wherein the cable assembly is configured to be wrapped around the support structure.

4. The enhanced exercise vest of claim 3, wherein an additional clip or ring or spring snap hook connector is configured to be attached to the second loop of the cable assembly and also to a cable of the cable assembly.

5. The enhanced exercise vest of claim 4, wherein the support structure is a fence, a pole, a workout support system, a volleyball extension, or a basketball extension.

6. The enhanced exercise vest of claim 3, wherein the support structure is a door jamb, further comprising a door jamb assembly configured to attach the cable assembly to the door jamb and an additional clip or ring or spring snap hook connector, wherein the second loop of the cable assembly is configured to be attached to the additional clip or ring or spring snap hook connector, and the additional clip or ring or spring snap hook connector is configured to be connected to one end of the door jamb connector and a second end of the door jamb connector is configured to be inserted into the door jamb.

7. The enhanced exercise vest of claim 1, wherein the two shoulder straps are attached to each other via a hook and loop fastening system.

8. The enhanced exercise vest of claim 1, wherein the weight attachment connecter is attached to a bottom side of the back part of the bottom portion of the enhanced exercise vest.

9. The enhanced exercise vest of claim 1, wherein the weight attachment connector connects the weight attachment to the enhanced exercise vest and the weight attachment connector is connected to the back part of the bottom portion of the enhanced exercise vest via one or more rivets.

10. The enhanced exercise vest of claim 1, wherein the two front sections and the back part of the bottom portion of the enhanced exercise vest are a unitary piece.

11. The enhanced exercise vest of claim 1, wherein the upper portion of the enhanced exercise vest is made of a nylon material and includes two rigid pieces that are configured to run vertically across a back of the user of the enhanced exercise vest.

12. The enhanced exercise vest of claim 1, wherein the bottom portion of the enhanced exercise vest is made of a stronger more rigid material than the upper portion of the enhanced exercise vest.

* * * * *